US006241245B1

(12) United States Patent
Hollar et al.

(10) Patent No.: US 6,241,245 B1
(45) Date of Patent: Jun. 5, 2001

(54) SHEET HANDLING SYSTEM FOR MINIMIZING SURFACE DEFECTS

(75) Inventors: Thomas C. Hollar, Penfield; Wayne C. Powley, Ontario, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/437,309

(22) Filed: Nov. 5, 1999

(51) Int. Cl.[7] ..... B65H 29/20
(52) U.S. Cl. ..... 271/314; 271/264; 271/272
(58) Field of Search ..... 271/264, 272, 271/314, 278, 8.1; 198/624

(56) References Cited

U.S. PATENT DOCUMENTS

| | | | | |
|---|---|---|---|---|
| 3,277,298 | * | 10/1966 | Tiger et al. | 271/272 |
| 5,000,438 | | 3/1991 | Sardano et al. | 271/264 |
| 5,456,456 | * | 10/1995 | Abe et al. | 271/186 |
| 5,893,558 | * | 4/1999 | König et al. | 271/264 |
| 5,915,692 | * | 6/1999 | Lu et al. | 271/279 |
| 6,134,418 | * | 10/2000 | Kato et al. | 271/207 |

* cited by examiner

*Primary Examiner*—H. Grant Skaggs
(74) *Attorney, Agent, or Firm*—Perman & Green, LLP

(57) ABSTRACT

Apparatus for transporting sheets in a longitudinal direction includes an improvement for reducing the imparting to the sheet material of friction, static charge, and foreign deleterious material while substantially minimizing the burnishing of the surface of the sheets. To this end, a plurality of elongated sheet supporting rib members project outwardly from a guide surface, extend diagonally relative to the longitudinal direction, are all of uniform height above the sheet guide surface, and are of uniform cross section. The sheet supporting rib members are so dimensioned and positioned that any random element of a sheet being fed in the longitudinal direction through the apparatus crosses only one of the sheet supporting rib members. Actually, a plurality of first sheet supporting rib members extend diagonally in a first direction and another plurality of elongated second sheet supporting rib members extend diagonally in a second direction which is transverse of the first direction. The incidence angle between the longitudinal direction and each of the sheet supporting rib members is in the range of about 5° to about 30° and, preferably, in the range of about 10° to about 20°. A drive roll mechanism may be provided for engaging the sheets in the region of the sheet supporting rib members.

15 Claims, 3 Drawing Sheets

SHEET HANDLING SYSTEM FOR MINIMIZING SURFACE DEFECTS

BACKGROUND OF THE INVENTION

1. Field of the Invention

The present invention relates generally to improved sheet feeding, with particular utility for document feeders or transports for sequentially feeding original document sheets. The invention serves to reduce the imparting to the sheet material being transported and handled of friction, static charge, and foreign deleterious material while substantially minimizing the burnishing of the surface of the sheet material being transported.

2. Description of the Prior Art

As xerographic and other copiers and other document handlers in general increase in speed and become more automatic in their operation, it is increasingly important to provide higher speed yet more reliable and more automatic handling of the resulting copies, in sheet material form, while at the same time maintaining the visual quality of those resulting copies.

Throughout this disclosure the term sheet is intended to refer both to individual sheets as well as to continuous web-fed media.

Standard paper guide design relies on a series of parallel in-line ribs to decrease overall friction on the sheet as it passes through the paper path. This method also ensures that a minimum of static, dirt, and moisture is transmitted from the baffle to the sheet. In most instances, these ribs are parallel to the direction of the sheet transporting path to which the sheets are confined. A patented example of a modified design in which the ribs are in a diagonal relationship with respect to the sheet feeding path is provided in commonly assigned U.S. Pat. No. 5,000,438 issued on Mar. 19, 1991 to Sardano et al. In this patented instance, apparatus is disclosed for feeding flimsy sheets of paper or the like, preferably dog-eared or curled edge original documents. To guide and flatten the non-planar edges of the sheets, the sheet feeding guide surface of the apparatus has a plurality of spaced apart and slightly vertically extending sheet-engaging ribs. These ribs are divided into two opposingly diagonal sets of plural ribs on the respective sides of the sheet feeding path, extending diagonally away from one another from the centerline of the sheet separator or feeder towards the respective outer edges of their respective side of the sheet feeding path. These diagonal ribs may have their upper surfaces in a common plane but can iron out towards their respective path sides the curled or folded corners of the sheet in that side of the path.

While this technique of using raised ribs is acceptable for most requirements, an undesirable outcome of parallel rib design is high paper surface element dwell time on a concentrated area of the rib/sheet interface. This situation may result in paper marking and rib surface wear. Paper marking becomes a larger issue with some document handling equipment when there is a requirement to accommodate coated stock papers or transparency material which are more sensitive to surface impressions caused by surface element dwell time and high concentration of pressure between the rib and sheet interface.

It was with knowledge of the foregoing state of the technology that the present invention has been conceived and is now reduced to practice.

SUMMARY OF THE INVENTION

The present invention relates to apparatus for transporting sheets in a longitudinal direction and includes an improvement for reducing the imparting to the sheet material of friction, static charge, and foreign deleterious material while substantially minimizing the burnishing of the surface of the sheets. To this end, a plurality of elongated sheet supporting rib members project outwardly from a guide surface, extend diagonally relative to the longitudinal direction. They may be all of uniform height above the sheet guide surface and be of uniform cross section although such uniform dimensioning is not necessary for the invention. The sheet supporting rib members are so dimensioned and positioned that any random element of a sheet being fed in the longitudinal direction through the apparatus crosses only one of the sheet supporting rib members. Actually, a plurality of first sheet supporting rib members extend diagonally in a first direction and another plurality of elongated second sheet supporting rib members extend diagonally in a second direction which is transverse of the first direction. The incidence angle between the longitudinal direction and each of the sheet supporting rib members is in the range of about 5° to about 30° and, preferably, in the range of about 10° to about 20°. A drive roll mechanism may be provided for engaging the sheets in the region of the sheet supporting rib members for transporting the sheets in the longitudinal direction. However, other mechanisms for advancing the sheets may be provided at other locations.

The technique herein disclosed seeks to provide a method to use angled sheet supporting rib members in a paper handling device to enable low rib to sheet surface pressures. The technique minimizes the marking of the sheet surface as it passes through the paper handling mechanism by decreasing the dwell time and the pressure of the sheet surface on the angled supporting rib members.

Throughout this disclosure, the term "burnish" will be intended to refer to a particular resulting optical effect which may occur for substrates such as sheets in the form of treated paper stock and transparencies which may be acrylic sheets. Coated paper stock has a "nap" which may be "laid down" when engaged, as by a sheet supporting rib member, visually affecting the optical quality of the sheet. In a similar fashion, such engagement of an acrylic sheet, or transparency, may affect its diffraction, being different at the locations of sheet supporting rib member engagement by a sheet supporting rib member than at all of the other locations on the sheet. Such burnishing can be particularly noticeable when images on the transparency are projected onto a screen and thereby magnified.

The arrangement of the sheet supporting rib members mitigate high sheet-to-rib surface pressures and dwell times by placing the rib members at an angle to the paper path sheet movement direction. The sheet supporting rib members are angled from the approximate center of the paper path, expanding toward the front and back edges of the paper path structure. This arrangement ensures that lateral forces applied to the sheet will have the positive effect of imparting a small lateral force from the center to the outside edges of the sheet to enable prevention of paper wrinkle. This method of rib arrangement has been found to be most effective on surface sensitive substrates with low frictional coefficients.

A primary feature, then, of the present invention is the provision of an improved technique for sheet handling by a document feeder or handler to reduce the imparting to the sheet material being fed and handled of friction, static charge, and foreign deleterious material while substantially minimizing the burnishing of the surface of the sheet material.

Another feature of the present invention is the provision of sheet handling apparatus in which a plurality of elongated sheet supporting rib members project outwardly from the guide surface, the sheet supporting rib members extending diagonally relative to the longitudinal direction, the sheet supporting rib members being so dimensioned and positioned that any random element of a sheet being fed in the longitudinal direction through the apparatus crosses only one of the sheet supporting rib members.

Still another feature of the present invention is the provision of such a technique according to which a plurality of elongated first sheet supporting rib members extend diagonally in a first direction and a plurality of elongated second sheet supporting rib members extend diagonally in a second direction which is transverse of the first direction.

Yet another feature of the present invention is the provision of such a technique according to which the incidence angle between the longitudinal direction and each of the sheet supporting rib members is in the range of about 5° to about 30° and, preferably, in the range of about 10° to about 20°.

Still a further feature of the present invention is the provision of such a technique according to which the sheet supporting rib members are all of uniform height above the sheet guide surface and of uniform cross section.

Yet a further feature of the present invention is the provision of such a technique according to which at least one drive roll mechanism is employed for engaging the sheets in the region of the sheet supporting rib members for transporting the sheets in the longitudinal direction.

Still another feature of the present invention is the provision of such a technique which is employed to transport sheets or substrates with sensitive surface characteristics such as coated stock papers and transparencies.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
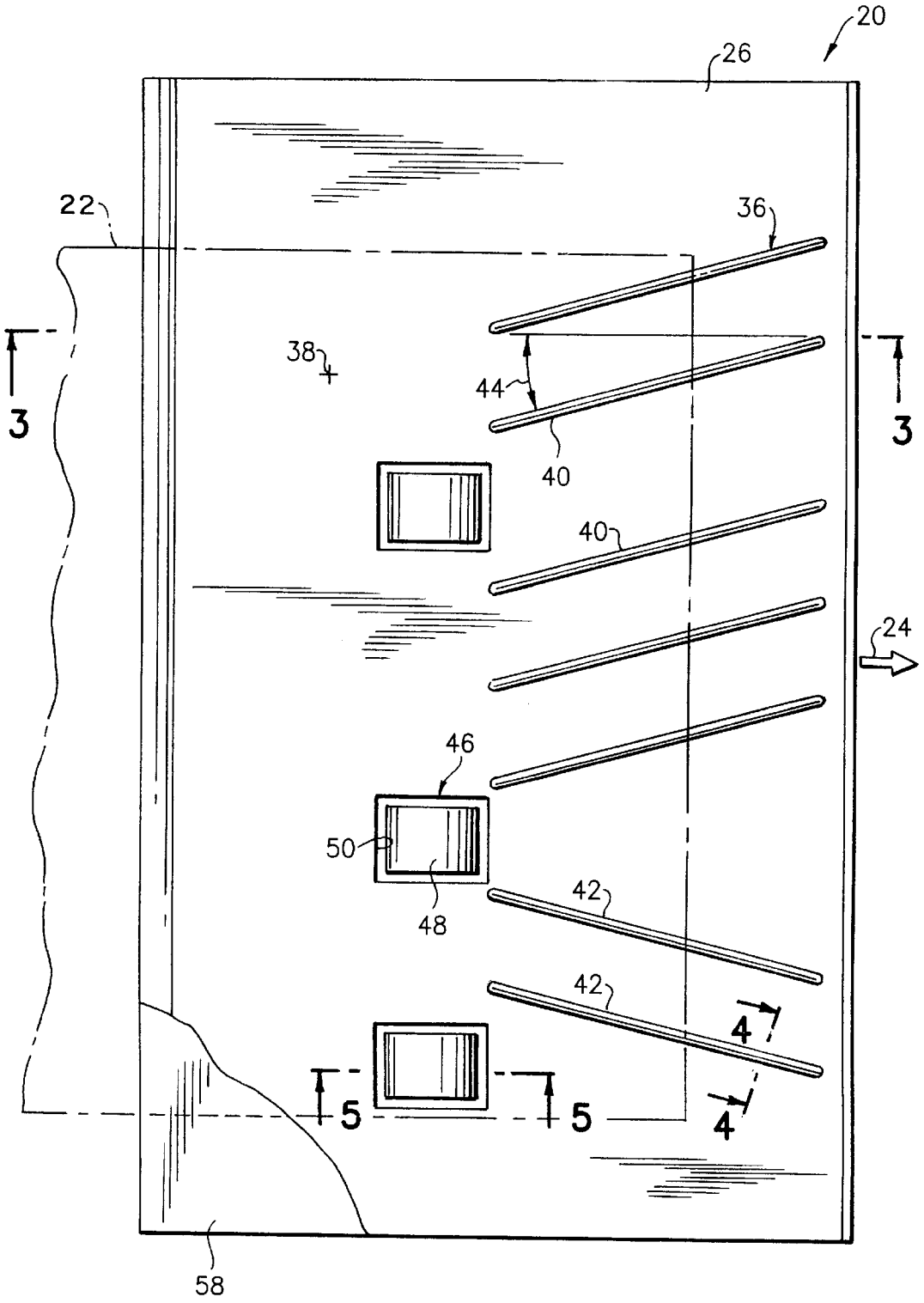
FIG. 1 is a top plan view, partially cut away, illustrating a portion of apparatus for transporting sheets in a longitudinal direction defined by a guide surface which embodies the invention.

Turn now to the drawings and, initially, to FIG. 1 which generally illustrates a component 20 of apparatus for transporting sheets 22 in a longitudinal direction as indicated by an arrow 24 and as defined by a guide surface 26. The sheets 22 may be paper which is chemically treated for a variety of purposes and having a relatively soft surface. In another instance, the sheets 22 may be of acrylic plastic material in the form of transparencies intended to be optically projected. In the instance of treated paper stock, the surface exhibits a nap which can be laid down by any object which engages and is drawn across its surface. The resultant effect which is readily noticeable to the untrained eye is referred to a "burnishing" and is undesirable. A similar effect results when an object engages and is drawn across the surface of a transparency. In this instance, there is an altering of optical diffraction in the burnished region as compared to the unburnished regions. This alteration is readily visible when the image on the transparency is projected onto a screen or other viewing surface.

Figure 2:
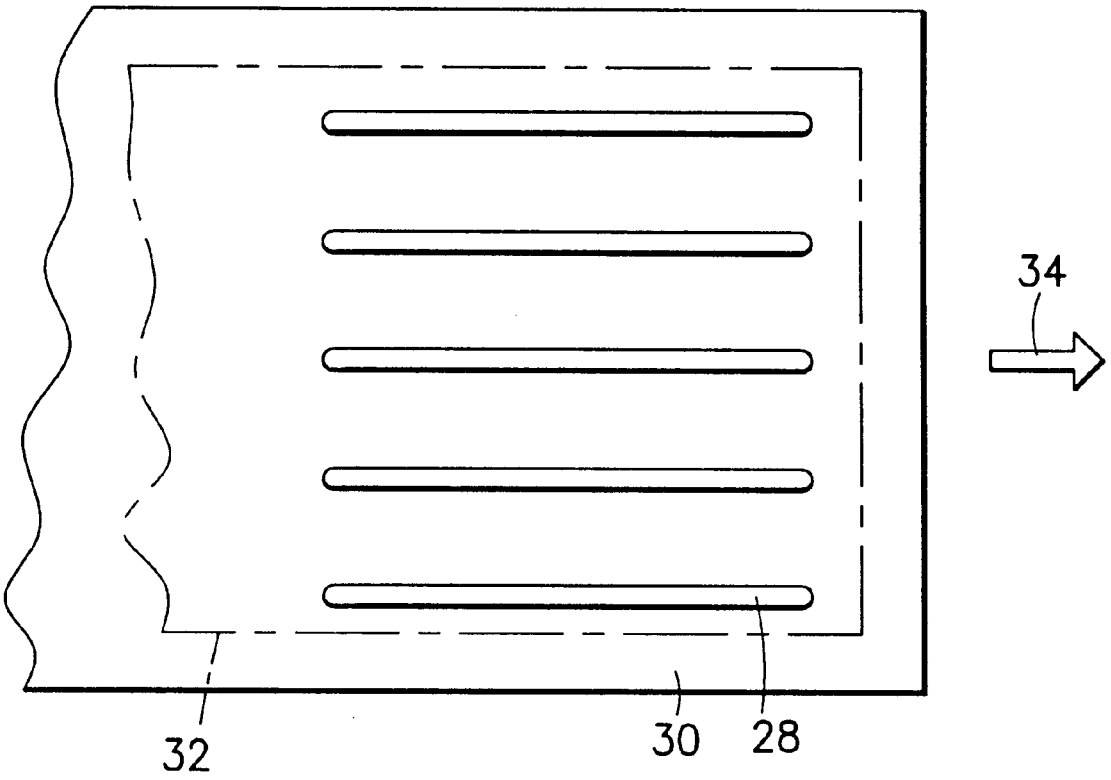
FIG.2 PRIOR ART
FIG. 2 is a detail top plan view of a portion of apparatus as illustrated in FIG. 1 but depicting a known construction.

Turning momentarily to FIG. 2, it has long been known to use rib members 28 projecting above a conventional guide surface 30 and extending in a longitudinal direction. Such use is to reduce friction imparted to sheet stock 32 in the form of bond paper, for example, as well as the build-up of static charge and foreign deleterious material on the paper as it is being advanced. Typically, the longitudinal direction of the rib members 28 is parallel to the direction in which the sheets 32 are being advanced as indicated by an arrow 34.

The goal of the present invention is to take advantage of this known benefit achieved with use of the rib members 28 while substantially minimizing the burnishing of the surface of the sheets 22. To this end, returning to FIG. 1, a plurality of elongated sheet supporting rib members 36 modified in accordance with the invention project outwardly from the guide surface 26. In this instance, the sheet supporting rib members 36 extend diagonally relative to the longitudinal direction indicated by the arrow 24. The sheet supporting rib members 36 are so dimensioned and positioned that any random element 38, or point location, represented as a cross, of the sheet 22 being fed in the longitudinal direction through the apparatus passes over only one of the sheet supporting rib members. It will be appreciated that while it is preferred that the rib members be parallel for aesthetic reasons as well as for ease of manufacture, such mutual orientation is not necessary for the invention to operate. In this manner, no part whatever of the sheet 22 is subjected to engagement by a rib member 36 more than any other part. Because of this mode of operation, the entire surface of the sheet 22 is uniformly affected such that no portion of the surface of the sheet is uniquely affected as compared to any other portion.

Figure 3:
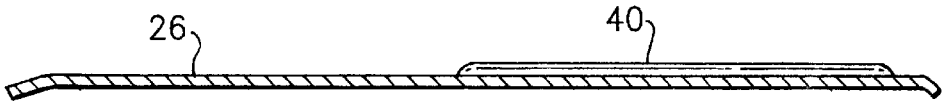
FIG. 3 is a cross section view taken generally along line 3—3 in FIG. 1.
Figure 5:
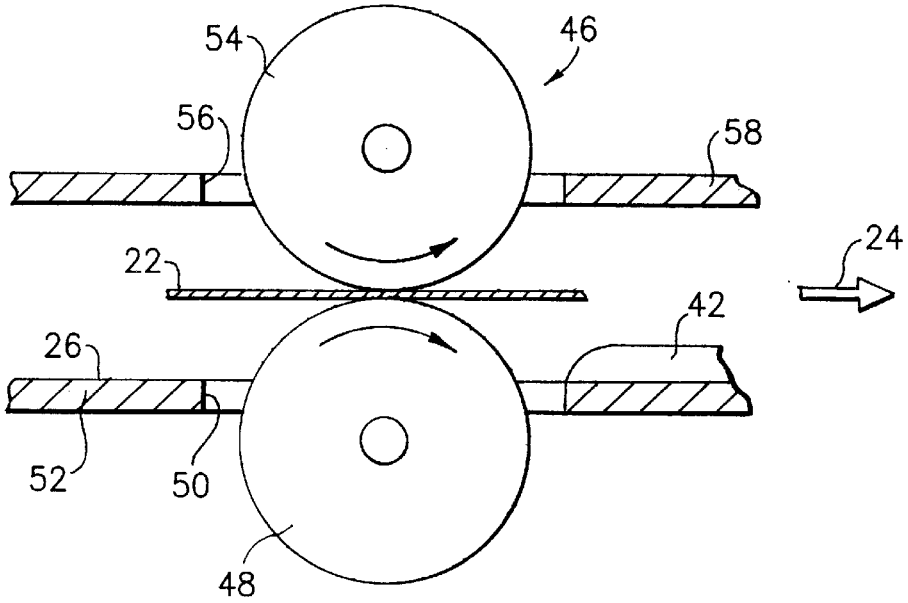
FIG. 5 is a cross section view taken generally along line 5—5 in FIG. 1.
Figure 4:
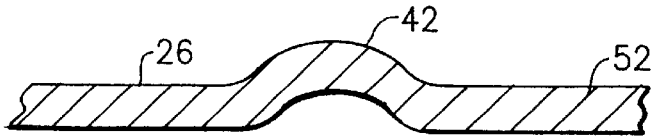
FIG. 4 is a cross section view taken generally along line 4—4 in FIG. 1.

With continuing reference to FIG. 1, it is seen that the elongated sheet supporting rib members 36 actually include a plurality of elongated first sheet supporting rib members 40 extending diagonally in a first direction and a plurality of elongated second sheet supporting rib members 42 extending diagonally in a second direction which is transverse of the first direction. As mentioned earlier, although the rib members 40 are illustrated as being generally parallel and that such relationship is a preferred one at least for manufacturing purposes, such is not required for purposes of the invention. The same holds true with respect to the rib members 42. A relationship which is important, however, is that the incidence angle 44 between the longitudinal direction, or direction of the arrow 24, and each of the sheet supporting rib members 40, 42 is in the range of about 5° to about 30° and preferably in the range of about 10° to about 20°. Also, as best seen in FIGS. 3 and 4, the sheet supporting rib members 40, 42 are all of uniform height above the sheet guide surface and of uniform cross section.

In a known manner, at least one drive roll mechanism 46 is provided for engaging the sheets 22 in the region of the sheet supporting rib members 40, 42 for transporting them in the longitudinal direction, that is, in the direction of the arrow 24. In actual fact, three laterally spaced drive roll mechanisms 46 are illustrated. In each instance, a drive roll 48 projects through an opening 50 in a lower support plate 52 on which the rib members 40, 42 are formed. In a similar manner, an idler roll 54 projects through an opening 56 in an upper support plate 58 generally parallel to and spaced from the lower support plate. The sheet 22 is firmly engaged at the locations of tangency of the rolls 48, 54 and thereby advanced in the direction of the arrow 24. As earlier explained, other mechanisms at other locations may be employed for advancing the sheets and, indeed, the sheets may actually be in a form of continuous paper.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. In an apparatus for transporting sheets in a longitudinal direction defined by a guide surface, the improvement for reducing the imparting to the sheet material of friction, static charge, and foreign deleterious material while substantially minimizing the burnishing of the surface of the sheets, the improvement comprising:

a plurality of elongated sheet supporting rib members integral with and projecting outwardly from the guide surface, the sheet supporting rib members extending diagonally relative to the longitudinal direction;

the sheet supporting rib members being so dimensioned and positioned that any point location of a sheet being fed in the longitudinal direction through the apparatus crosses only one of the sheet supporting rib members.

2. Sheet material transporting apparatus as set forth in claim 1 wherein the plurality of elongated sheet supporting rib members includes:

a plurality of elongated first sheet supporting rib members extending diagonally in a first direction; and a plurality of elongated second sheet supporting rib members extending diagonally in a second direction which is transverse of the first direction.

3. Sheet material transporting apparatus as set forth in claim 1 wherein the incidence angle between the longitudinal direction and each of the sheet supporting rib members is in the range of about 5° to about 30°.

4. Sheet material transporting apparatus as set forth in claim 1 wherein the incidence angle between the sheet feeding direction and each of the sheet feeding rib members is in the range of about 10° to about 20°.

5. Sheet material transporting apparatus as set forth in claim 1 wherein the sheet supporting rib members are all of uniform height above the sheet guide surface and of uniform cross section.

6. Sheet material transporting apparatus as set forth in claim 1 including:

at least one drive roll mechanism for engaging the sheets in the region of the sheet supporting rib members for transporting the sheets in the longitudinal direction.

7. Sheet material transporting apparatus as set forth in claim 1 including:

a plurality of laterally spaced drive roll mechanisms for engaging the sheets in the region of the sheet supporting rib members for transporting the sheets in the longitudinal direction.

8. A process for transporting sheets in a longitudinal direction defined by a guide surface so as to reduce the imparting to the sheet material of friction, static charge, and foreign deleterious material while substantially minimizing the burnishing of the surface of the sheets, the process comprising the steps of:

(a) providing a plurality of elongated sheet supporting rib members integral with and projecting outwardly from the guide surface and extending diagonally relative to the longitudinal direction;

(b) dimensioning and positioning the sheet supporting rib members such that any point location of a sheet being fed in the longitudinal direction through the apparatus crosses only one of the sheet feeding rib members.

9. The process as set forth in claim 8 wherein step (a) includes the steps of:

(c) providing a plurality of elongated first sheet supporting rib members extending diagonally in a first direction; and (d) providing a plurality of elongated second sheet supporting rib members extending diagonally in a second direction which is transverse to the first direction.

10. The process as set forth in claim 8 wherein the incidence angle between the longitudinal direction and each of the sheet supporting rib members is in the range of about 5° to about 30°.

11. The process as set forth in claim 8 wherein the incidence angle between the longitudinal direction and each of the sheet supporting rib members is in the range of about 10° to about 20°.

12. The process as set forth in claim 8 wherein the sheet supporting rib members are all of uniform height above the sheet guide surface and of uniform cross section.

13. The process as set forth in claim 8 including the step of:

(c) engaging the sheets in the region of the sheet supporting rib members with at least one drive roll for transporting the sheets in the longitudinal direction.

14. The process as set forth in claim 8 including the step of:

(d) engaging the sheets in the region of the sheet supporting rib members with a plurality of laterally spaced drive roll mechanisms for transporting the sheets in the longitudinal direction.

15. Apparatus for transporting sheets in a longitudinal direction comprising:

a guide surface over which the sheets advance; and a plurality of elongated sheet supporting rib members integral with and projecting outwardly from the guide surface, the sheet supporting rib members extending diagonally relative to the longitudinal direction;

the sheet supporting rib members being so dimensioned and positioned that any point location of a sheet being fed in the longitudinal direction through the apparatus crosses only one of the sheet supporting rib members whereby friction, static charge, and foreign deleterious material imparted to the sheet material is reduced while substantially minimizing the burnishing of the surface of the sheets.

* * * * *